US006603451B1

(12) United States Patent
Mergler et al.

(10) Patent No.: US 6,603,451 B1
(45) Date of Patent: Aug. 5, 2003

(54) DISPLAY ARRANGEMENT

(75) Inventors: Iwo-Martin Mergler, Southampton (GB); Neil M. Johnson, Harefield (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 7 days.

(21) Appl. No.: 09/691,813

(22) Filed: Oct. 19, 2000

(30) Foreign Application Priority Data

Oct. 23, 1999 (GB) ..... 9925054

(51) Int. Cl.[7] ..... G09G 3/36

(52) U.S. Cl. ..... 345/87; 345/84; 345/88; 345/89; 345/63; 345/204

(58) Field of Search ..... 345/84, 87–89, 345/113, 136, 139, 147–153, 63, 203; 358/455, 429, 456; 349/33, 41

(56) References Cited

U.S. PATENT DOCUMENTS

| | | | | |
|---|---|---|---|---|
| 5,703,621 A | | 12/1997 | Martin et al. | 345/147 |
| 5,748,163 A | | 5/1998 | Han | 345/88 |
| 5,757,347 A | | 5/1998 | Han | 345/88 |
| 5,870,503 A | | 2/1999 | Kumashiro | 382/252 |
| 6,064,359 A | * | 5/2000 | Lin et al. | 345/692 |
| 6,198,469 B1 | * | 3/2001 | Tjandrasuwita | 345/690 |
| 6,239,781 B1 | * | 5/2001 | Fujisawa | 345/208 |
| 6,288,698 B1 | * | 9/2001 | Ishii et al. | 345/204 |
| 6,347,159 B1 | * | 2/2002 | Williams et al. | 358/1.9 |

FOREIGN PATENT DOCUMENTS

| | | | |
|---|---|---|---|
| EP | 0848369 A2 | 6/1998 | G09G/3/36 |

OTHER PUBLICATIONS

"Dithering with Blue Noise", by Robert A. Ulichney, Proceedings of the IEEE, vol. 76, No. 1, Jan. 1988.

* cited by examiner

*Primary Examiner*—Bipin Shalwala
*Assistant Examiner*—Leonid Shapiro

(57) ABSTRACT

A display arrangement is disclosed comprising a flat panel display device having an array of pixels, and a driving circuit arrangement for switching each of the pixels between two intensity levels at a rate greater than the frame refresh rate so as to produce the visible effect of intermediate intensity levels. In particular, the driving circuit comprises a plurality of intensity level error registers, one for each intermediate intensity level; means for selecting one of the intensity level error registers according to.a signal representative of the visible effect of the intermediate intensity level that it is desired that a particular pixel should produce; means for setting the particular pixel to either a first or second intensity level depending on the value contained in the selected error register; and means for updating the value contained in the selected register by adding a value corresponding to the first or second intensity level to which the particular pixel was set, subtracting a value corresponding to the intermediate intensity level, the visible effect of which it is desired that the particular pixel should produce, and adding a random number.

5 Claims, 3 Drawing Sheets

DISPLAY ARRANGEMENT

BACKGROUND OF THE INVENTION

1. Field of Invention

The invention relates to a display arrangement and to a method of driving such a display arrangement.

2. Description of the Related Art

Standard color LCD (Liquid Crystal Display) panels are normally controlled digitally and are therefore unable to display more than eight basic color combinations (two intensity levels per color, that is red, green, and blue). In order to overcome this limitation it is known to switch a pixel quickly, that is at a rate greater than the frame refresh rate, between its two intensity levels to artificially generate intermediate intensity levels. This, however, introduces further problems. The simplest way of implementing the faster switching of pixels is to use a frame wide pulse width modulation arrangement but this requires an increase in frame rate by a factor equal to the required number of intensity levels. In addition there are limitations in the performance of typical display panels, such as the maximum shift clock rate and increased power consumption. In addition a higher frame rate requires a proportionate increase in the frame buffer bandwidth. It is possible to use static dithering techniques to imitate a higher color depth. While this option works well with high resolution static images such as in color printing, the larger pixel size associated with an LCD panel combined with the high contrast between adjacent pixels produces a high visible noise in the displayed image.

One of the properties of LCD panels is the relatively slow response of the crystals to changes in the applied signal. The switching times of each LCD pixel can be of the order of tens and even sometimes hundreds of milliseconds. This behavior improves the performance of a pixel switching algorithm, but switching complete frames is still too noticeable at low frame rates.

It is known that the visibility of the flicker is dependent on the area of the flickering surface. Consequently, using different switching patterns for adjacent pixels can significantly reduce the flicker. The human brain is, however, highly specialized in pattern and shape recognition and as a result regular patterns in space and in time are very noticeable, usually as moving or trembling structures.

To overcome these problems the use of a pseudo-random noise source as the basis of a dynamic dithering scheme has been proposed and described in U.S. Pat. No. 5,703,621. The arrangement described uses a two dimensional error propagation scheme in order to produce correct shading for narrow vertical structures. While this is satisfactory as far as the displayed image is concerned it has the disadvantage of requiring complex hardware and/or software for its implementation. Consequently it is a relatively expensive solution.

A much less expensive solution would be possible if a one dimensional error propagation scheme was used. This, however, results in an inability to produce correct shading for narrow vertical structures.

BRIEF SUMMARY OF THE INVENTION

It is an object of the invention to enable the production of images using an LCD having a greater number of levels of resolution than that provided by the pixel switching levels using dynamic dithering which is less expensive to implement than known two dimensional error propagation schemes.

The present invention provides a display arrangement comprising a flat panel display device having an array of pixels, and a driving circuit arrangement for switching each of the pixels between two intensity levels at a rate greater than the frame refresh rate so as to produce the visible effect of intermediate intensity levels, wherein the driving circuit comprises a plurality of intensity level error registers, one for each intermediate intensity level; means for selecting one of the intensity level error registers according to a signal representative of the visible effect of the intermediate intensity level that it is desired that a particular pixel should produce; means for setting the particular pixel to either a first or second intensity level depending on the value contained in the selected error register; and means for updating the value contained in the selected register by adding a value corresponding to the first or second intensity level to which the particular pixel was set, subtracting a value corresponding to the intermediate intensity level, the visible effect of which it is desired that the particular pixel should produce, and adding a random number.

The provision of a separate error register for each intensity level it is desired to reproduce enables narrow vertical structures to be reproduced without requiring the use of two dimensional error propagation schemes which require the storage of the propagation errors of a complete line. In effect a one dimensional error propagation scheme is implemented for each of the intensity levels it is desired to reproduce. Thus if it is desired to reproduce eight gray scale levels then six error registers will be needed. Clearly separate error registers are not needed for black and white.

BRIEF DESCRIPTION OF DRAWINGS

The above and other features and advantages of the invention will be apparent from the following description, by way of example, of an embodiment of the invention with reference to the accompanying drawings, in which.

DETAILED DESCRIPTION OF THE PRESENT INVENTION

Figure 1:
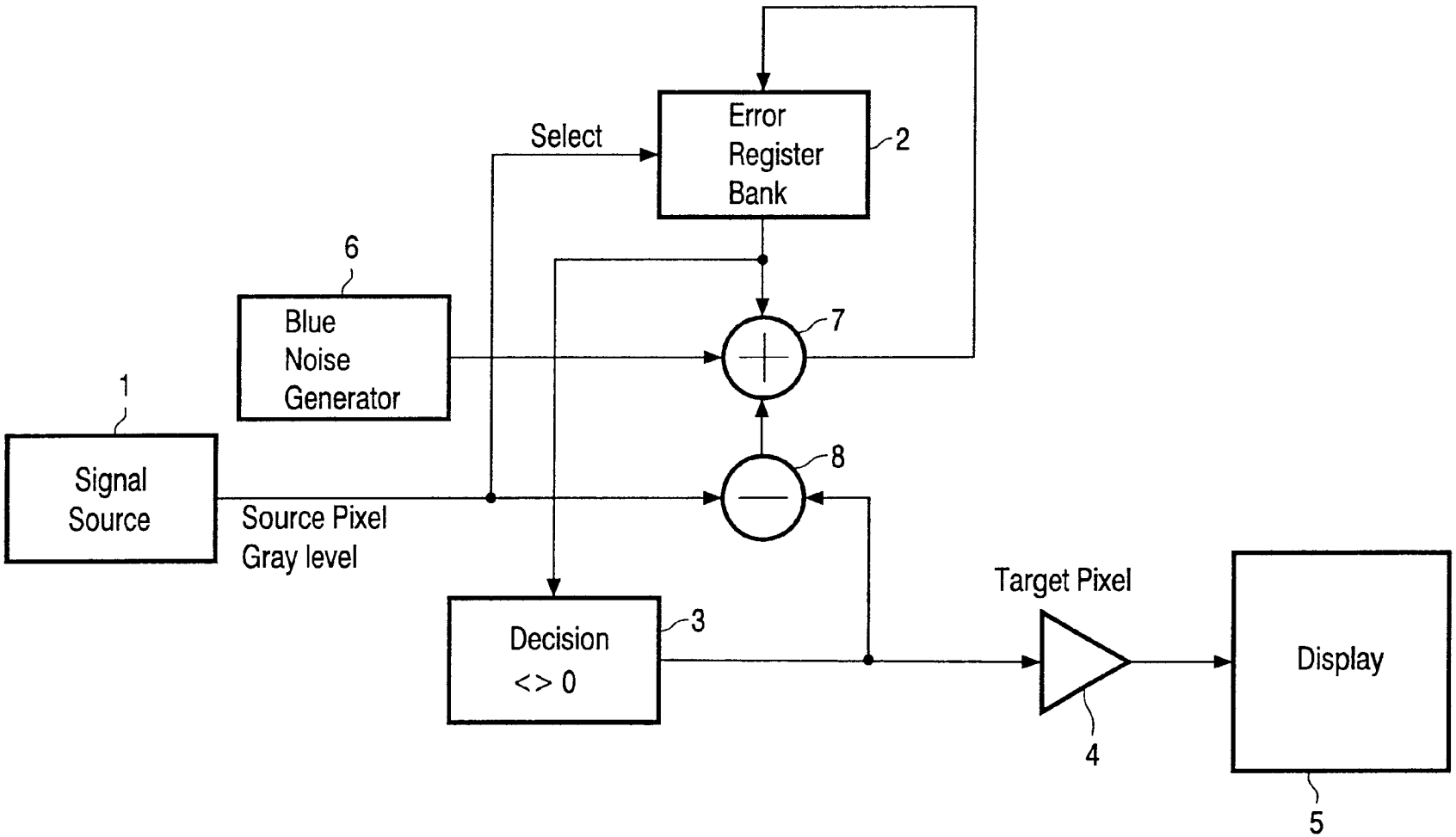
FIG. 1 shows in block schematic form a display arrangement according to the invention.

FIG. 1 shows in block schematic form a display arrangement comprising a conventional signal source 1 which produces a signal representative of the intensity level it is desired that a given pixel should produce. This signal may define a color intensity or a gray level depending on whether a color or monochrome display is required. In the following description the term "gray level" will be used for simplicity but it will be understood that such usage is intended to cover both monochrome and color display arrangements and should be interpreted accordingly. The signal from the signal source 1, which is preferably in digital form, is fed to an appropriate one of a plurality of error registers forming an error register bank 2. The particular error register to which the signal is applied is selected according to the amplitude or gray level of the signal. The output of the selected error register is connected to the input of a decision circuit 3 whose output is fed to an LCD driver circuit 4, which drives a conventional display 5. A blue noise generator 6 has its output connected to a first input of a summing arrangement 7, a second input of which is connected to the output of the selected error register of the error register bank 2. The output of the summing arrangement 7 is connected to the input of the selected error register. The output of the signal source 1 is further connected to a first input of a subtractor arrangement 8, while the output of the decision circuit 3 is further connected to a second input of the subtractor arrangement 8. The output of the subtractor arrangement 8 is connected to a third input of the summing arrangement 7.

The following description of a error register updating method represented by a flowchart illustrated in FIG. 3 will explain the operation of the apparatus described with reference to FIG. 1. Each error register in the error register bank 2 is initially blank. The signal from the signal source 1 is used to select the error register in the error register bank 2 that is allocated to the particular gray level represented by the signal during a stage S10 of the flowchart. During a stage S12 of the flowchart, the output of that error register is fed to the decision circuit 3 where it is determined whether the contents of the error register are greater than or equal to one. If it is, then the output of the decision circuit 3 connected to the LCD driver circuit 4 causes the driver circuit 4 to set the target pixel to black during a stage S14*a* of the flowchart. The input signal is then subtracted from the black level by the subtracting arrangement 8 during a stage S16*a* of the flowchart and the result is added to the value in the selected error register during a stage S18 of the flowchart and then entered into the error register during a stage S28 of the flowchart. If the decision circuit 3 determines that the error register value is less than one, then it causes the driver circuit 4 to set the target pixel to white during a stage S14*b* of the flowchart. The input signal is then subtracted from the white level during a stage S16*b* of the flowchart and the result is added to the value in the selected error register during stage S18 of the flowchart and then entered into the error register during stage S20 of the flowchart. In both cases, a random value generated by the blue noise generator 6 is also added to the value in the error register during stage S18 of the flowchart. This affects the local accuracy of the reproduced intensity but produces the required dynamics over time. Because the mean value of the noise source is zero there is no global bias in the intensity distribution. An intentionally generated offset in the noise signal generated may, however, be used to compensate for non-linearity in the display.

The following Table 1 provides an exemplary updating of a "very light color" error register having an initial value of 0, where the "very light color" error register has an input signal value of 5, a black color has an intensity value of 1, a very dark color has an intensity value of 2, a dark color has an intensity value of 3, a light color has an intensity value of 4, a very light color has an intensity value of 5, and a white color has an intensity value of 6:

TABLE 1

| Pixel | White/Black | Random | Updated Register |
|---|---|---|---|
| 1 | 6 | 0 | 1 |
| 2 | 1 | 2 | −1 |
| 3 | 6 | 2 | 2 |
| 4 | 1 | −1 | −3 |
| 5 | 6 | 0 | −2 |
| 6 | 6 | −1 | −2 |
| 7 | 6 | 2 | 1 |
| 8 | 1 | 0 | −3 |
| 9 | 6 | −2 | −4 |
| 10 | 6 | 2 | −1 |
| 11 | 6 | −1 | −1 |
| 12 | 6 | 2 | 2 |
| 13 | 1 | 1 | −1 |
| 14 | 6 | 0 | 0 |

TABLE 1-continued

| Pixel | White/Black | Random | Updated Register |
|---|---|---|---|
| 15 | 6 | 0 | 1 |
| 16 | 1 | 2 | −1 |
| 17 | 6 | −1 | −1 |
| 18 | 6 | 2 | 2 |
| 19 | 1 | 0 | −2 |
| 20 | 6 | 0 | −1 |
| AVERAGES | 4.5 | 0.45 | |

Each update of the "very light color" error register is the sum of a preceding update of the error register, the value of 1 or 6 corresponding to whether the pixel is set at black or white, respectively, and a random number. The value 5 representing the very light color intensity level the visible effect of which is intended to be reproduced is subtracted from the sum to obtain the update value for the "very light color" error register.

Accordingly, the "very light color" error register is updated with a value of 1 for the first update from a sum of (0(contents of error register)+6(black intensity value)+0 (random number))−5(input signal value).

The "very light color" error register is updated with a value of −1 for the second update from a sum of (1(contents of error register)+1(black intensity value)+2(random number))−5(input signal value).

The "very light color" error register is updated with a value of 2 for the third update from a sum of (−1(contents of error register)+6(black intensity value)+2(random number))−5(input signal value).

Figure 3:
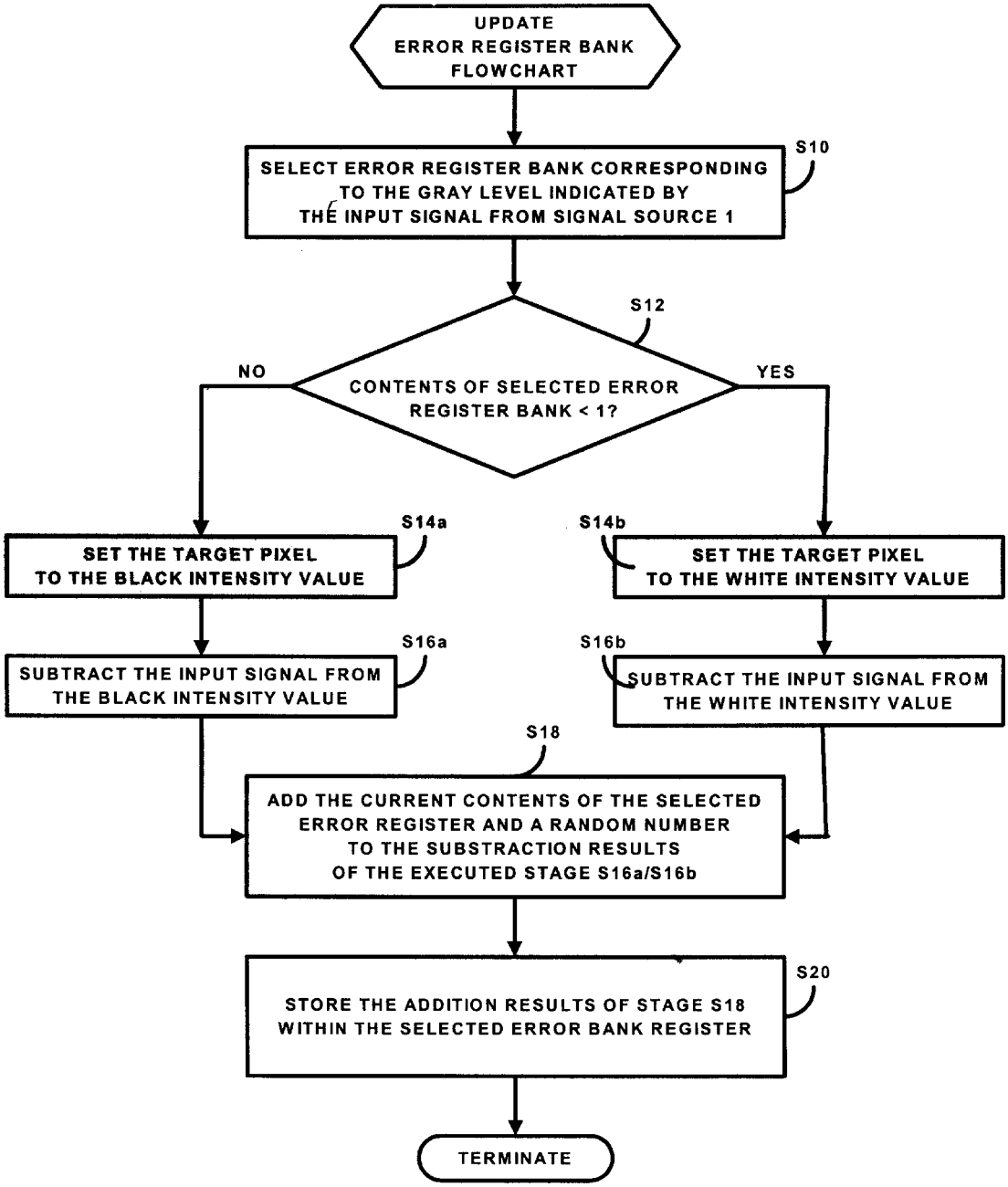
FIG. 3 shows a flow chart illustrative of an error register updating feature of the present invention.

The remaining seventeen (17) updates are also executed in accordance with the flowchart illustrated in FIG. 3.

It will be apparent that a separate error register is used for each intermediate intensity level it is desired to reproduce to keep track of the cumulative error produced in the dithered image so far. Assuming an original image with six (6) distinct gray levels and a target display capable of black and white only a local error of +/−5 is possible at every pixel location. As an example, for a gray level of two (2) in the source image, making the targeted pixel white produces a local error of +4 (i.e., 6−2). If this is then added to the error register for that gray level and this value is used in the decision for the next pixel having the intensity level five the overall error in the image is kept between +/−5."

A common problem of all error propagation algorithms is the global response to local events. In this context that is a small area at one level within a large one at a different level will influence the dither pattern for the large area. In some instances this produces highly visible artifacts in the image produced. In addition border effects in the direction of error propagation tend to occur with steps in the gray level.

By using a separate error register for each gray level, the global response is damped and the border effects substantially reduced. In the present embodiment a plurality of error registers are used and the input signal level selects which one of them is used. The gray level of the input signal can be regarded as the error register address selecting which one is to be used to drive the pixel Since each gray level selects a different error register within the error register bank 2, error propagation does not take place over successive pixels but instead takes place over successive pixels having the same desired intensity. Consequently these errors will not accumulate at boundaries, where intensity levels vary in a stepwise manner, and therefore narrow vertical structures can be more faithfully defined without requiring classical two dimensional error propagation. The present arrangement uses a one dimensional error propagation scheme but this error propagation is separately carried out for each intensity level.

Figure 2:
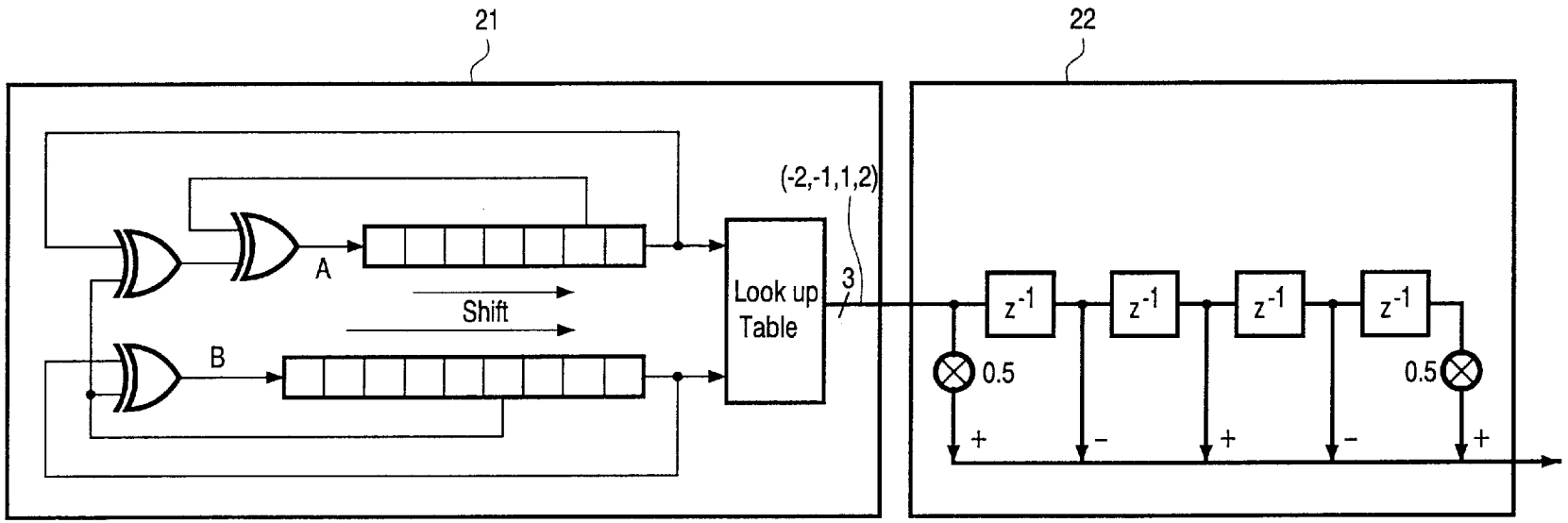
FIG. 2 shows an embodiment of a blue noise generator suitable for use in the embodiment of FIG. 1.

FIG. 2 shows an embodiment of a blue noise source suitable for use as the blue noise generator 6 in the display arrangement of FIG. 1. As shown in FIG. 2, the blue noise generator comprises a pseudo-random sequence generator 21 followed by a high pass filter 22. The implementation of such functions is well known to those skilled in the art, but typically the generator 21 will comprise one or more shift registers with selected one(s) of the stages fed back to the input and the high pass filter 22 will conveniently be a digital filter so that its output will be a random bit stream with lower frequencies suppressed.

The use of a blue noise generator reduces the possibility of producing slow flickering of the intensity of individual pixels because of the absence of a low frequency component in the noise spectrum.

The spectral distribution of noise is often described by a color. The best known is white noise which is so named because its power spectrum is constant across all frequencies of interest in the same way as white light in the visible spectrum. Low frequency noise is often known as pink noise while blue noise is used to refer to noise that has very little low frequency content and may be considered as the complement of pink noise. Robert A. Ulichney disclosed the concept of blue noise in a paper entitled "Dithering with Blue Noise" published in Proceedings of the IEEE, Vol. 76 No.1, January 1998.

In order to produce color displays it is usual to provide for each pixel three sub pixels each comprising a liquid crystal element and having a filter overlaying it. These filters are normally red, green, and blue and as a result the combined display by the pixel will take an appropriate color. In this case, the display would be driven by an RGB signal and each of the three components would be provided with a separate bank of error registers, decision circuits, adders, and drivers.

From reading the present disclosure, other modifications will be apparent to persons skilled in the art. Such modifications may involve other features which are already known in the design and use of display methods and apparatus and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalization of one or more of those features which would be obvious to persons skilled in the art, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

What is claimed is:

1. A display arrangement, comprising:

a flat panel display device having an array of pixels; and a driving circuit arrangement for switching each of the pixels between two intensity levels at a rate greater than the frame refresh rate so as to produce the visible effect of intermediate intensity levels, wherein said driving circuit includes an intensity level error register for each intermediate intensity level, means for selecting one of said intensity level error registers according to a signal representative of the visible effect of the intermediate intensity level that is desired that a particular pixel should produce, means for setting the particular pixel to either a first intensity level or a second intensity level depending on the value contained in said selected intensity level error register; and means for updating the value contained in said selected intensity level error register by adding a value corresponding to the first intensity level or the second intensity level to which the particular pixel was set, subtracting a value corresponding to the intermediate intensity level, the visible effect of which it is desired that the particular pixel should produce, and adding a random number.

2. The display arrangement of claim 1, wherein each pixel includes three sub-pixels of different colors, each sub pixel being associated with its own plurality of registers.

3. A display arrangement, comprising:

a flat panel display device (5) having an array of pixels; and a driving circuit arrangement for driving each of the pixels by means of a two level signal, the two level signal switching at a multiple of a frame rate so as to produce the visible effect of a multi-intensity image, wherein said driving circuit includes a plurality of intensity level registers, one for each intensity level to be reproduced, means for applying a source signal for a pixel of interest to a first intensity level register corresponding to a source intensity level, means for setting the pixel value to a first intensity level if a register content of said first intensity level register is greater than or equal to a given threshold value and then adding a first value to the register content of said first intensity level register, the first value being a differential between the first intensity level and the source intensity level, means for setting the pixel value to a second intensity level if the register content of said first intensity level register is less than the threshold value and adding a second value to the register contents of said first intensity level register, the second value being a differential between the second intensity level and the source intensity level, and means for adding a random number to the register content of said first intensity level register.

4. The display arrangement of claim 3, wherein each pixel includes three sub-pixels of different colors, each sub pixel being associated with its own plurality of registers.

5. A method of driving a flat panel display comprising an two dimensional array of pixels using a driving circuit arrangement to obtain a multi-intensity picture display, said method comprising:

i) providing a driving circuit arrangement for driving each of the pixels based on a two level signal, ii) causing the driving circuit to produce said two level signal at a multiple of the frame rate, iii) providing in the driving circuit arrangement a plurality of intensity level registers, one for each intensity level to be reproduced, iv) applying a source signal for a pixel of interest to a first intensity level register corresponding to a source intensity level, v) setting the pixel level to a first intensity level if a register content of the first intensity level register is greater than or equal to a threshold value and, if so, adding a first value to the register content of the first intensity level register, the first value being a differential between the first intensity level and the source signal intensity, vi) setting the pixel level to a second intensity level if the register content of the first intensity level register is less than the threshold value and, if so, adding a second value to the register content of the first intensity level register, the second value being a differential between the second intensity level and the source signal intensity, and vii) adding a random number to the register content of the first intensity level register.

* * * * *